US008882155B2

(12) United States Patent
Dittly et al.

(10) Patent No.: US 8,882,155 B2
(45) Date of Patent: Nov. 11, 2014

(54) ASSEMBLY FOR FASTENING A FITTING TO A MANIFOLD

(75) Inventors: Bruce W. Dittly, North Tonawanda, NY (US); Joseph B. Czach, Lockport, NY (US); Warren L. Gawve, Churchville, NY (US); Joel T. Hambruch, Burt, NY (US); Kevin M. Snyder, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 600 days.

(21) Appl. No.: 13/020,321

(22) Filed: Feb. 3, 2011

(65) Prior Publication Data

US 2012/0199318 A1 Aug. 9, 2012

(51) Int. Cl.
*F16L 41/12* (2006.01)
*F28F 9/02* (2006.01)

(52) U.S. Cl.
CPC ..... *F28F 9/0251* (2013.01)
USPC ..... 285/197; 285/133.11

(58) Field of Classification Search
USPC ..... 285/129.1, 133.11, 197
See application file for complete search history.

(56) References Cited

U.S. PATENT DOCUMENTS 1,709,751 A * 4/1929 Shipley ..... 285/197
2,239,651 A * 4/1941 McMurray et al. ..... 285/197
4,494,780 A * 1/1985 Burnett ..... 285/148.26
4,961,597 A * 10/1990 Bowen ..... 285/24
5,105,844 A * 4/1992 King, Sr. ..... 137/15.14
5,169,177 A * 12/1992 McLennan et al. ..... 285/23
5,346,003 A 9/1994 Halstead et al.
5,360,241 A * 11/1994 Gundy ..... 285/197
5,694,972 A * 12/1997 King ..... 137/318
5,749,412 A 5/1998 Balthazard
6,123,143 A 9/2000 Insalaco
6,357,472 B1 * 3/2002 King ..... 137/318
6,557,373 B1 5/2003 Nitta
7,213,640 B2 5/2007 Fuller
7,322,616 B2 * 1/2008 Lang ..... 285/197
8,128,128 B2 * 3/2012 Dittly et al. ..... 285/197
2003/0030275 A1 * 2/2003 Nicolini et al. ..... 285/197
2010/0154188 A1 6/2010 Corser et al.

* cited by examiner

*Primary Examiner* — James Hewitt
(74) *Attorney, Agent, or Firm* — James M. Chan

(57) ABSTRACT

An assembly for fastening a fitting to a hole in a tubular manifold having a hole. A plurality of refrigerant tubes extend into the manifold transversely to the hole. The assembly includes a fitting that extends along an axis and defines an opening to provide clearance for the refrigerant tubes extending into the manifold. The fitting also presents a pair of slots in spaced and parallel relationship with one another. The assembly further includes a semi-cylindrical shaped mounting plate including a bracket. The bracket presents a pair of legs which extend in spaced and parallel relationship with one another and engage the slots of the fitting to limit rotary movement of the fitting about the axis relative to the bracket before and during brazing of the fitting to the manifold to maintain a clearance between the lower section of the fitting and the refrigerant tubes.

6 Claims, 4 Drawing Sheets

ASSEMBLY FOR FASTENING A FITTING TO A MANIFOLD

BACKGROUND OF THE INVENTION

1. Field of the Invention

The subject invention relates to an assembly for fastening a fitting to a hole in a manifold.

2. Description of Related Art

Heat exchangers with manifolds and a fitting secured thereto are widely used in commercial, residential and vehicle applications. Generally, the fitting is oriented in the same direction as the refrigerant tubes where space is the greatest, as shown by U.S. Pat. No. 7,213,640 issued to Fuller et al. on May 8, 2007. However, this type of connection can be undesirable because it adds significantly to the overall length of the heat exchanger. Therefore, it is desirable to attach the fitting in a transverse direction to the refrigerant tubes. The problem with attaching fittings in a transverse direction to the refrigerant tubes is the close proximity of the refrigerant tubes to the side of the manifold and the amount of manifold space left to provide the fitting. Furnace brazing is a desirable method of connecting fittings to manifolds for mass production and to ensure that the fitting is sealed to the manifold. One known method of securing fittings prior to furnace brazing is to tack weld the fitting in place. However, welding requires a great skill set, can be expensive due to time and labor costs, and leaves the fitting at risk of tilting or drooping during the brazing process which is especially undesirable due to the limited amount of space in the manifold. A known alternative to welding for securing a fitting prior to furnace brazing is to use a bracket assembly. An example of a bracket configuration is shown in European Patent Application EP 1,496,329 to Maciej et al. published on Dec. 1, 2005. EP 1,496,329 discloses a manifold with a bracket presenting a leg for engaging a slot on a fitting block. The fitting block is oriented in the same direction as the refrigerant tubes.

There is a significant and continuing need for a fitting connected to the manifold in a transverse direction to the refrigerant tubes that provides adequate clearance for the refrigerant tubes and is sufficiently held in place during furnace brazing.

SUMMARY OF THE INVENTION

The invention provides an assembly for fastening a fitting to a hole in a manifold that receives refrigerant tubes that extend into the manifold transverse the hole in the manifold. The assembly includes a fitting that extends along an axis and presents a pair of slots spaced from one another. In addition, the fitting has a lower section that defines an opening to provide clearance for the refrigerant tubes extending into the manifold. The assembly further includes a bracket that presents a pair of legs that extend in spaced relationship with one another. The legs engage the slots of the fitting to limit rotary movement of the fitting about the axis relative to the bracket before and during brazing of the fitting to the manifold for maintaining clearance between the lower section of the fitting and the refrigerant tubes.

The subject invention also provides a method of fastening a fitting to a hole in a manifold that receives refrigerant tubes that extend into the manifold transverse the hole in the manifold. The method includes the step of providing a fitting that defines an axis, and presents a pair of slots in spaced and parallel relationship with one another. The fitting has a lower section with an opening to provide clearance for the refrigerant tubes. The method also includes the step of providing a bracket that includes a pair of legs spaced from one another. The method further includes the step of locating the fitting in the hole of the manifold. In addition, the method includes the step of brazing the fitting to the manifold. Furthermore, the method includes the step of connecting the bracket and the fitting with the legs of the bracket disposed in the slots of the fitting to limit rotary movement of the fitting about the axis relative to the bracket before and during brazing of the fitting to the manifold for maintaining clearance between the lower section of the fitting and the refrigerant tubes.

Thus several advantages of one or more aspects of the invention are the elimination of a tack weld prior to furnace brazing, a compact design due to the fact that the fitting extends in a transverse direction to the refrigerant tubes, the reduction of the risk of tilting or drooping of the fitting during furnace brazing, error proofing due to the ease of assembly of the fitting and bracket, and increased process control due to the fact that the lower part of the fitting can be common regardless of connection requirements, allowing the use of only one sized manifold hole, bracket and braze ring.

BRIEF DESCRIPTION OF THE DRAWING(S)

Advantages of the present invention will be readily appreciated as the same becomes better understood by reference to the following detailed description and the accompanying drawings that set forth an exemplary embodiment wherein.

DETAILED DESCRIPTION OF THE ENABLING EMBODIMENTS

Referring to the Figures, wherein like numerals indicate corresponding parts throughout the several views, an assembly 20, 120 for fastening a fitting 22, 122 to a hole in a manifold 26, 126 having a tubular shape and receiving refrigerant tubes 28 extending into the manifold 26, 126 transverse the hole in the manifold 26, 126 is generally shown.

Figure 1:
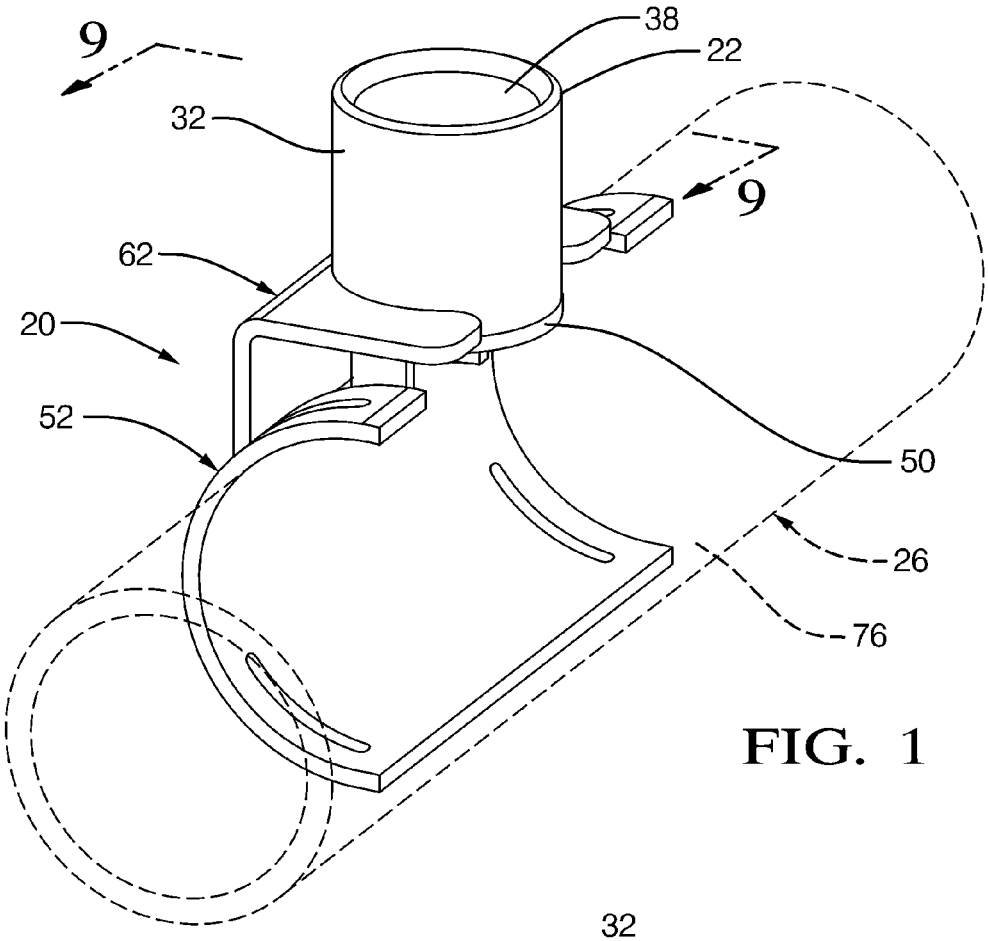
FIG. 1 is perspective view of the assembly of the first enabling embodiment.
Figure 2:
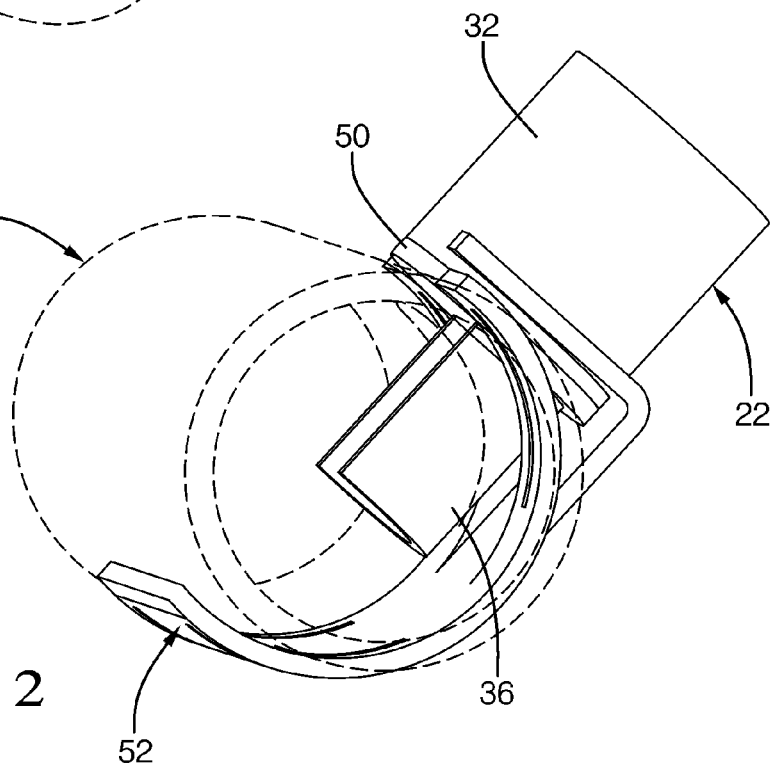
FIG. 2 is a perspective view of the assembly of the first enabling embodiment.
Figure 3:
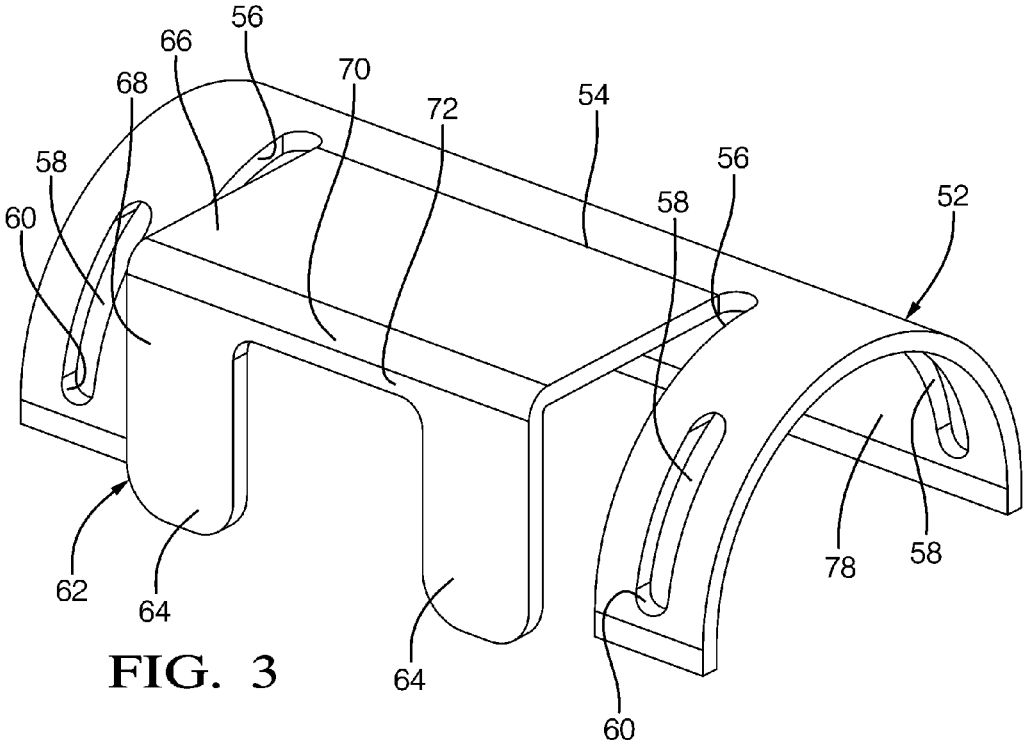
FIG. 3 is a perspective view of the mounting plate and bracket of the first enabling embodiment.
Figure 4:
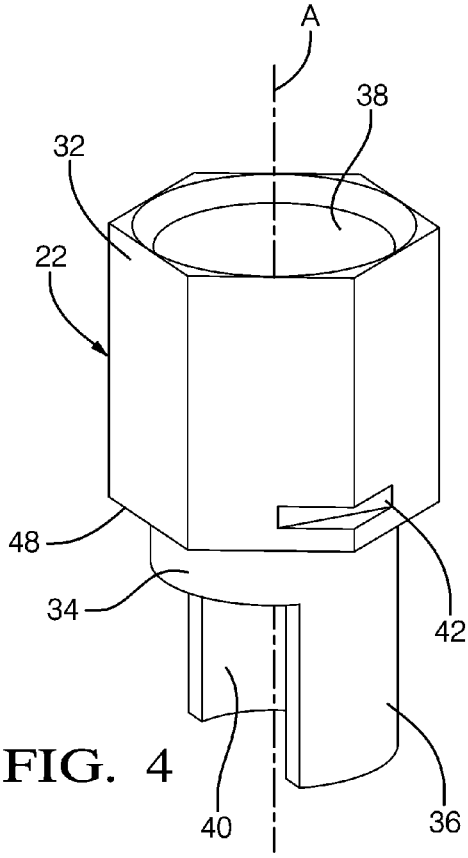
FIG. 4 is a perspective view of the fitting of the first enabling embodiment.
Figure 5:
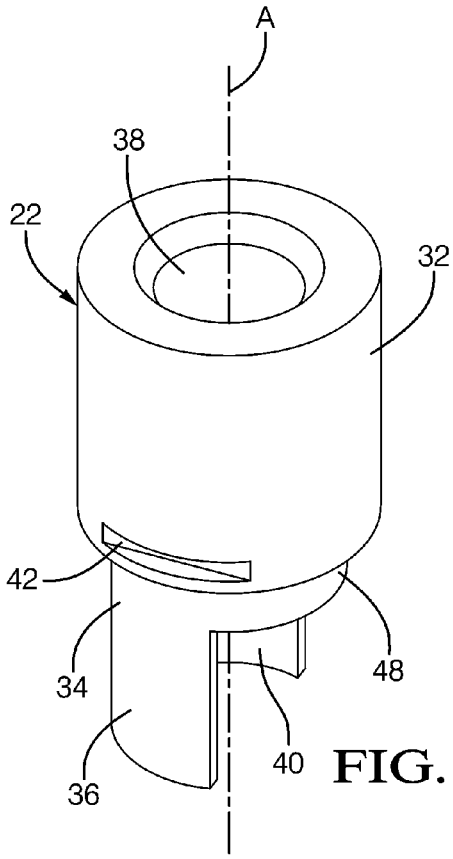
FIG. 5 is a perspective view of the fitting of the first enabling embodiment.

The assembly 20, 120 includes a fitting 22, 122 extending along an axis A. The fitting 22, 122 has an upper section 32, 132, an intermediate section 34, 134 and a lower section 36, 136. A passage 38, 138 for conveying a fluid extends along the axis A through the upper 32, 132, intermediate 34, 134 and lower sections 36, 136. The lower section 36, 136 has a semi-cylindrical shape that defines an opening 40, 140 into the passage 38, 138. The opening 40, 140 provides clearance for the refrigerant tubes 28 extending into the manifold 26, 126, ensuring adequate flow of fluid through the manifold 26, 126, refrigerant tubes 28 and fitting 22, 122. The upper section 32, 132 of the fitting 22, 122 presents a pair of slots 42, 142 in spaced and parallel relationship with one another. It should be appreciated that more than a pair of slots 42, 142 could be used and the slots 42, 142 don't have to be parallel with one another. In addition, it should be appreciated that the upper section 32, 132 of the fitting 22, 122 could have various shapes and sizes to suit different connection requirements as best shown in FIGS. 4 and 5. The intermediate section 34, 134 of the fitting 22, 122 has a cylindrical shape, however it should be appreciated that other shapes could be used, so long as it matches the shape of the hole of the manifold 26, 126. The upper section 32, 132 of the fitting 22, 122 has an upper thickness and the intermediate section 34, 134 of the fitting 22, 122 has an intermediate thickness, wherein the upper thickness is greater than the intermediate thickness to present a shoulder 48, 148 separating the two sections 32, 132, 34, 134. A braze ring 50, 150 is disposed about the intermediate section 34, 134 and abuts the shoulder 48, 148 for brazing the fitting 22, 122 to the manifold 26, 126 around the hole therein. In other words, the braze ring 50, 150 is disposed between the shoulder 48, 148 of the fitting 22, 122 and the manifold 26, 126, allowing the fitting 22, 122 and manifold 26, 126 to be brazed together during the brazing process. It should be appreciated that that any brazing material could be used as an alternative to the braze ring 50, 150.

Figure 9:
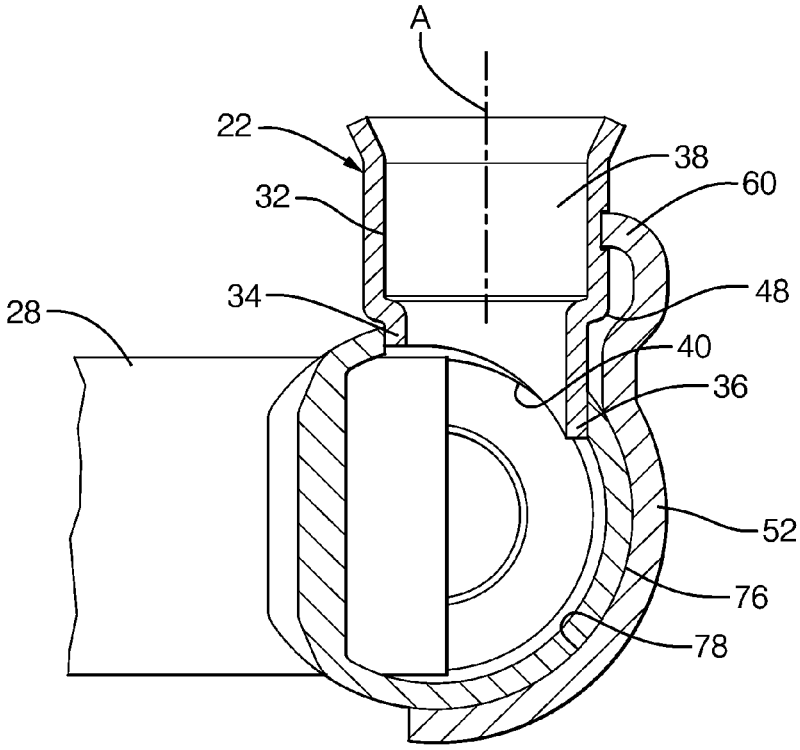
FIG. 9 is a cross sectional view of the assembly taken along 9-9 of FIG. 1.

The assembly 20, 120 further includes a semi-cylindrical shaped mounting plate 52, 152. The mounting plate 52, 152 has a semi-cylindrical shape for concentric mating with the manifold 26, 126. The mounting plate 52, 152 includes a rear face 54, 154 and a pair of side faces 56, 156. Furthermore, the mounting plate 52, 152 includes a plurality of apertures 58, 158, each having a peripheral portion 60, 160. One of the apertures 58, 158 is disposed adjacent to each of the side faces 56, 156 and an additional pair of apertures 58, 158 is disposed on the opposing side of the mounting bracket 62, 162. The apertures 58, 158 are used for skiving the mounting plate 52, 152 to the manifold 26, 126. During skiving, material from the manifold 26, 126 is displaced against the peripheral portion 60, 160 of the apertures 58, 158 to secure the mounting plate 52, 152 to the manifold 26, 126. It should be appreciated that any number of apertures 58, 158 could be used, and the apertures 58, 158 could be located at different locations across the mounting plate 52, 152, so long as the mounting plate 52, 152 is capable of being skived to the manifold 26, 126. Furthermore, the mounting plate 52, 152 includes a bracket 62, 162. The bracket 62, 162 presents a pair of legs 64, 164 which extend in spaced and parallel relationship with one another. The legs 64, 164 engage the slots 42, 142 of the fitting 22, 122 to limit rotary movement of the fitting 22, 122 about the axis A relative to the bracket 62, 162 before and during brazing of the fitting 22, 122 to the manifold 26, 126 for maintaining clearance between the lower section 36, 136 and the refrigerant tubes 28 as best shown in FIG. 9. It should be appreciated that more than a pair of legs 64, 164 could be used, and they don't necessarily have to be parallel with one another, so long as they engage the slots 42, 142 of the fitting 22, 122 to limit rotary movement of the fitting 22, 122 about the axis A relative to the bracket 62, 162.

In a first enabling embodiment shown in FIGS. 1-5, the slots 42 of the upper section 32, of the fitting 22 extend transversely to the axis A of the fitting 22 and are circumferentially spaced on diametrically opposite sides of the upper section 32. The bracket 62 extends outwardly from the rear face 54 of the mounting plate 52 and includes a first mounting piece 66 and a second mounting piece 68. The first mounting piece 66 extends tangentially from the rear face 54 of the mounting plate 52 to a front edge 70. The second mounting piece 68 extends perpendicularly from the first mounting piece 66 to give the bracket 62 an L-shape. The second mounting piece 68 has a U-shape including a base 72 and the legs 64 for engaging the slots 42 of the fitting 22.

Figure 6:
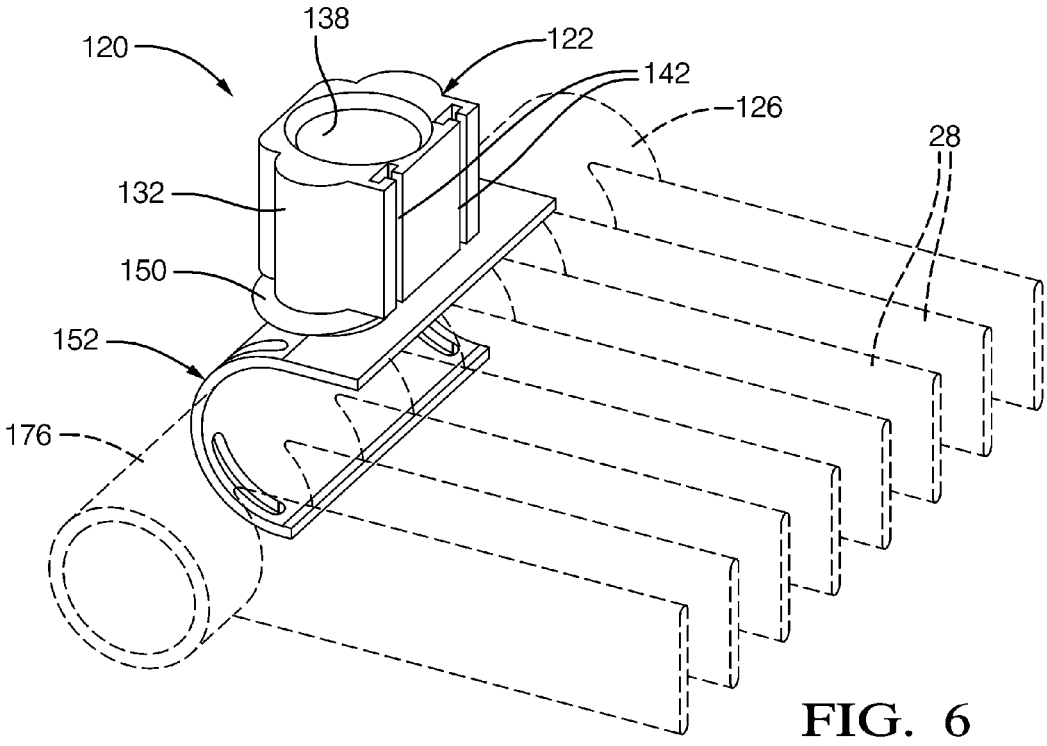
FIG. 6 is a perspective view of the assembly of the second enabling embodiment.
Figure 7:
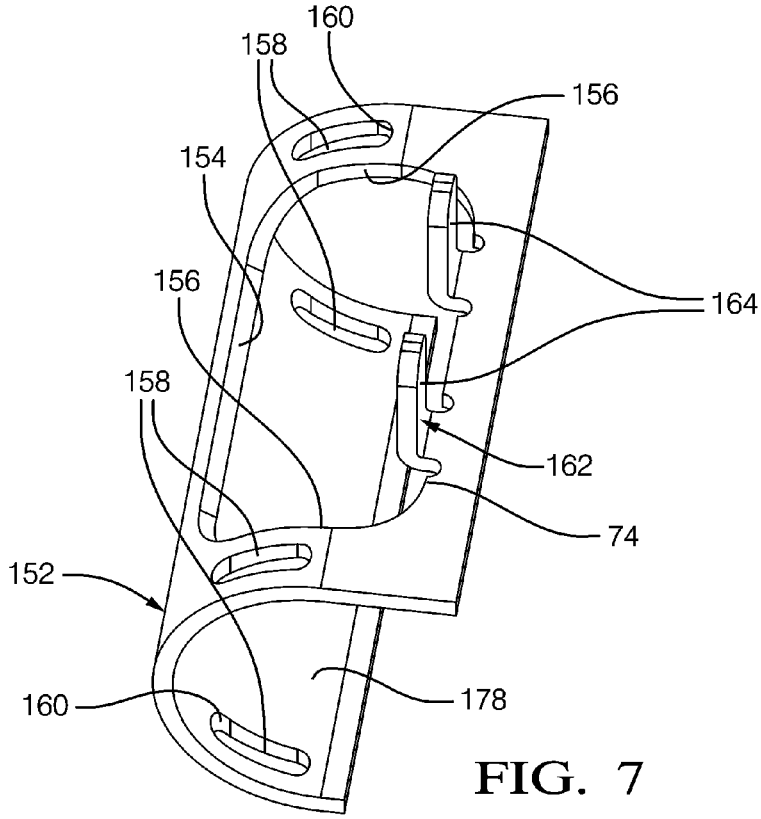
FIG. 7 is a perspective view of the bracket of the mounting plate and bracket of the second enabling embodiment.
Figure 8:
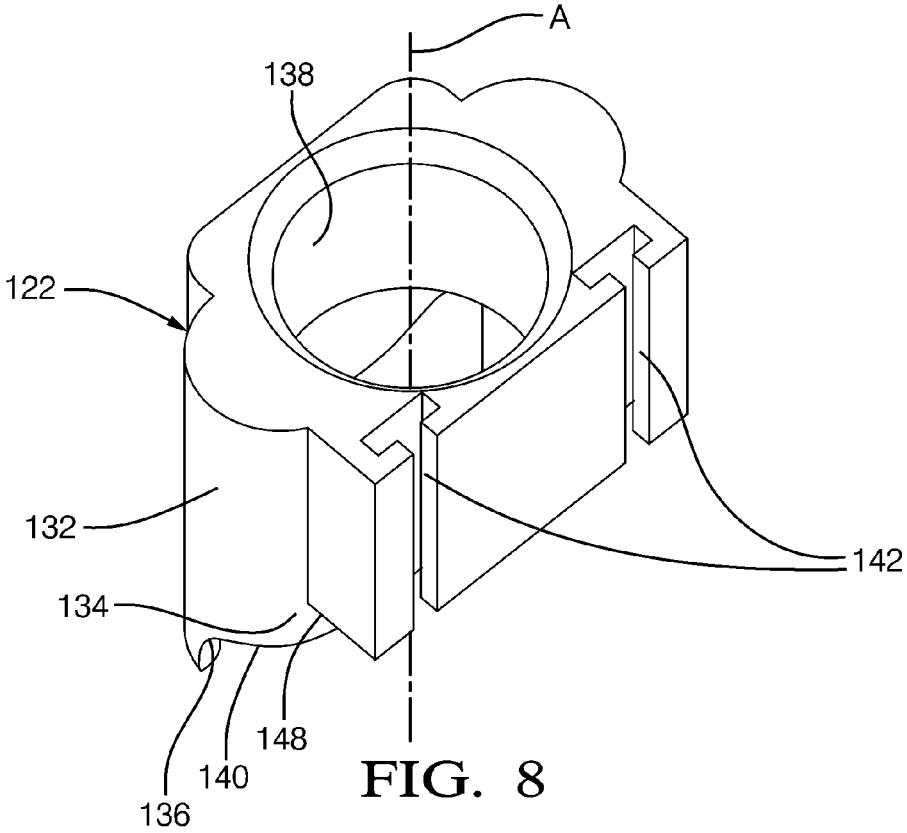
FIG. 8 is a perspective view of the fitting of the fitting of the second enabling embodiment.

In a second enabling embodiment, shown in FIGS. 6-8, the slots 142 of the upper section 132 of the fitting 122 extend axially. The mounting plate 152 further defines a front face 74. The pair of legs 164 of the bracket 162 extend perpendicularly from the front face 74 of the mounting plate 152 for engaging the slots 142 of the upper section 132 of the fitting 122.

A method for fastening a fitting 22, 122 to a hole in a manifold 26, 126 having a tubular shape and an outer surface 76, 176 and receiving refrigerant tubes 28 extending into the manifold 26, 126 transverse the hole in the manifold 26, 126 is also included.

The method starts with the step of providing a fitting 22, 122 defining an axis A and having an upper section 32, 132, an intermediate section 34, 134 and a lower section 36, 136. The upper section 32, 132 includes a pair of slots 42, 142 in spaced and parallel relationship to one another. The intermediate section 34, 134 includes a braze ring 50, 150 disposed thereabout. The lower section 36, 136 has an opening 40, 140 for providing clearance for the refrigerant tubes 28. The next step is to provide a mounting plate 52, 152 having a semi-cylindrical shape. The mounting plate 52, 152 includes an inner surface 78, 178 and presents a plurality of apertures 58, 158. Each of the apertures 58, 158 has a peripheral portion 60, 160. Furthermore, the mounting plate 52, 152 presents a bracket 62, 162 having a pair of legs 64, 164 extending in spaced and parallel relationship with one another. The next step is to locate the fitting 22, 122 into the hole of the manifold 26, 126 with the braze ring 50, 150 of the fitting 22, 122 in contact with the manifold 26, 126 outer surface 76, 176. The next step is to locate the mounting plate 52, 152 on the manifold 26, 126 outer surface 76, 176. While locating the mounting plate 52, 152 on the manifold 26, 126 outer surface 76, 176, the bracket 62, 162 and the fitting 22, 122 are connected with the legs 64, 164 of the bracket 62, 162 disposed in the slots 42, 142 of the fitting 22, 122. This connection limits rotary movement of the fitting 22, 122 about the axis A relative to the bracket 62, 162 before and during brazing of the fitting 22, 122 to the manifold 26, 126 for maintaining clearance between the lower section 36, 136 of the fitting 22, 122 and the refrigerant tubes 28. The next step is to skive the inner surface 78, 178 of the mounting plate 52, 152 to the outer surface 76, 176 of the manifold 26, 126 by displacing material from the manifold 26, 126 outer surface 76, 176 and deforming it against the edge of the peripheral portions 60, 160 of the apertures 58, 158. The next step is to braze the fitting 22, 122 to the manifold 26, 126 in a brazing furnace.

For the second enabling embodiment of FIGS. 6-8, the mounting plate 152 is located on the outer surface 76, 176 of the manifold 26, 126 prior to locating the fitting 122 into the hole of the manifold 26, 126 and connecting the bracket 162 and the fitting 122.

While the invention has been described with reference to an exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An assembly for fastening a fitting to a hole in a manifold receiving refrigerant tubes extending into the manifold transverse the hole in the manifold, said assembly comprising:

a fitting extending along an axis and presenting at least a pair of slots spaced from one another, said fitting having a lower section defining an opening providing clearance for the refrigerant tubes extending into the manifold, and a bracket presenting at least a pair of legs extending in spaced relationship with one another for engaging said at least a pair of slots of said fitting to limit rotary movement of said fitting about said axis relative to said bracket before and during brazing of said fitting to the manifold for maintaining clearance between said lower section of said fitting and the refrigerant tubes, wherein said fitting further includes an intermediate section and an upper section, wherein said upper section of said fitting has an upper thickness and said intermediate section has an intermediate thickness wherein said upper thickness is greater than said intermediate thickness to present a shoulder separating said upper and intermediate sections, wherein a braze ring is disposed about said intermediate section and abuts said shoulder for brazing said fitting to the manifold around the hole therein.

2. An assembly for fastening a fitting to a hole in a manifold receiving refrigerant tubes extending into the manifold transverse the hole in the manifold, said assembly comprising:

a fitting extending along an axis and presenting at least a pair of slots spaced from one another, said fitting having a lower section defining an opening providing clearance for the refrigerant tubes extending into the manifold, and a bracket presenting at least a pair of legs extending in spaced relationship with one another for engaging said at least a pair of slots of said fitting to limit rotary movement of said fitting about said axis relative to said bracket before and during brazing of said fitting to the manifold for maintaining clearance between said lower section of said fitting and the refrigerant tubes, a mounting plate having a semi-cylindrical shape for concentric mating with the manifold.

3. The assembly as set forth in claim 2 wherein said mounting plate includes said bracket and said at least a pair of legs of said bracket extend in parallel relationship with one another.

4. The assembly as set forth in claim 2 wherein said mounting plate presents a plurality of apertures having a peripheral portion and spaced axially therealong for skiving said mounting plate to the manifold.

5. An assembly for fastening a fitting to a hole in a manifold having a tubular shape and receiving refrigerant tubes extending into the manifold transverse the hole in the manifold, said assembly comprising:

a fitting extending along an axis having a having an upper section and an intermediate section and a lower section, said fitting defining a passage extending along said axis through said upper section and said intermediate section and said lower section for conveying a fluid, said upper section presenting a pair of slots in spaced and parallel relationship with one another, said intermediate section having a cylindrical shape, said upper section of said fitting having an upper thickness and said intermediate section of said fitting having an intermediate thickness, said upper thickness being greater than said intermediate thickness to present a shoulder separating said upper and intermediate sections, a braze ring disposed about said intermediate section and abutting said shoulder for brazing said fitting to the manifold around the hole therein, a mounting plate having a semi-cylindrical shape for concentric mating with the manifold, said mounting plate presenting a plurality of apertures spaced axially therealong for skiving said mounting plate to the manifold, each of said plurality of apertures having a peripheral portion, said mounting plate defining a pair of side faces and a rear face, one of said plurality of apertures being disposed adjacent to each of said pair of side faces, and said lower section having a semi-cylindrical shape defining an opening into said passage and providing clearance for the refrigerant tubes extending into the manifold, and said mounting plate including a bracket presenting a pair of legs extending in spaced and parallel relationship with one another for engaging said slots of said fitting to limit rotary movement of said fitting about said axis relative to said bracket before and during brazing of said fitting to the manifold for maintaining clearance between said lower section and the refrigerant tubes.

6. The assembly as set forth in claim 5 and further comprising:

said slots of said upper section of said fitting extending transversely to said axis of said fitting and circumferentially spaced on diametrically opposite sides of said upper section, said bracket extending outwardly from said rear face of said mounting plate for engaging the fitting further including a first mounting piece and a second mounting piece, and said first mounting piece extending tangentially from said rear face of said mounting plate to a front edge and said second mounting piece extending perpendicularly from said first mounting piece to give said bracket an L-shape, and said second mounting piece having a U-shape including a base and said pair of legs for engaging said slots of said fitting to limit rotary movement of said fitting about said axis relative to said bracket before and during brazing for maintaining clearance between said lower section and the refrigerant tubes.

* * * * *